US005388418A

United States Patent [19]

Martin et al.

[11] Patent Number: 5,388,418

[45] Date of Patent: Feb. 14, 1995

[54] REFRIGERATOR WITH IMPROVED CONTROL MECHANISM

[75] Inventors: Jerry C. Martin, Corydon, Ind.; Martin M. Zentner, Louisville, Ky.

[73] Assignee: General Electric Company, Louisville, Ky.

[21] Appl. No.: 207,373

[22] Filed: Mar. 4, 1994

[51] Int. Cl.[6] ..... F25B 49/00

[52] U.S. Cl. ..... 62/131; 62/264; 62/440; 362/94

[58] Field of Search ..... 62/131, 264, 440; 362/92, 94; 312/401, 408, 223.5

[56] References Cited

U.S. PATENT DOCUMENTS 4,936,106 6/1990 Beach et al. ..... 62/131

5,177,976 1/1993 Lim et al. ..... 62/440

*Primary Examiner*—John M. Sollecito

*Attorney, Agent, or Firm*—H. Neil Houser

[57] ABSTRACT

A refrigerator has a refrigeration control mechanism including a base mounted in the food storage compartment. The base includes a support plate extending generally horizontally side-to-side in the compartment. A pair of thermostats are mounted under opposite end portions of the plate and a lamp is mounted between the thermostats. Each thermostat has an operating handle extending forward of the plate. A bezel is removably mounted to the base and extends along the front of the plate aligned with the thermostats and lamp. The bezel includes two slots which receive the handles and permit sliding movement of the handles to adjust the thermostats. The slots and handles are sized to permit removal of the bezel without removing the handles. A light shield, removably mounted to the base, includes a bottom wall extending under the plate, aligned with the thermostats and lamp, and a frame encompassing the periphery of the bezel. The upper edge of the frame overlaps the upper edge of the bezel.

11 Claims, 3 Drawing Sheets

28

REFRIGERATOR WITH IMPROVED CONTROL MECHANISM

BACKGROUND OF THE INVENTION

This invention relates to refrigerators and, more particularly, to an improved mechanism for controlling the temperature in the freezer and fresh food compartments of side-by-side refrigerators.

Side-by-side refrigerators include a freezer and a fresh food storage compartment arranged in a side-by-side relationship. Typically, the refrigerator includes only a single evaporator, which is positioned in the freezer. The desired temperature range of the freezer is maintained by a freezer thermostat, which includes a sensing bulb located in the freezer to sense the temperature of the freezer and operate the refrigeration system. The desired temperature range of the fresh food compartment is maintained by a fresh food thermostat that senses the temperature in that compartment and controls the flow of cold air from the freezer to the fresh food compartment.

For the convenience of the user, it is preferred to place both the freezer and fresh food thermostats, and their operating mechanisms, in the fresh food compartment. More particularly, it is desirable to include them in a composite assembly or mechanism located in the upper rear portion of the fresh food compartment. Other operative components, such as a lamp to illuminate the fresh food compartment, also are included in the control assembly. Typically, a cover assembly is included in the control mechanism to protect the operative components and provide a pleasing appearance. Normally the operating handles for the thermostats extend through the cover for easy access by the user. From time to time it is desired to gain access to the control mechanism, such as, for example, to change the lamp. It is desirable that the user be able to remove the cover assembly with a minimum of effort and without having to also remove many other components, such as the thermostat operating handles.

It is an object of this invention to provide refrigerator with an improved mechanism for controlling the temperature of the freezer and fresh food storage compartments.

It is another object of this invention to provide such an improved mechanism in which the cover assembly is easily removed for access to operating components.

It is yet another object of this invention to provide such an improved mechanism in which the bezel and light shield may be removed without removing the operating handles of the thermostats.

SUMMARY OF THE INVENTION

In accordance with one embodiment of this invention a refrigerator has a liner defining a freezer and a fresh food compartment in a side-by-side relationship and separated by a mullion. A refrigerator control assembly or mechanism includes a base mounted in the fresh food compartment, including an elongated support plate extending horizontally transverse to the mullion. The plate includes a first opening closer to the mullion and a second opening more remote from the mullion.

A fresh food thermostat is mounted under the plate and has a rotary control shaft aligned with the first opening. A freezer thermostat is mounted under the plate and has a rotary control shaft aligned with the second opening. A fresh food pinion gear is positioned above the plate and is connected to the fresh food control shaft for rotation therewith. A freezer pinion gear is positioned above the plate and is connected to the freezer control shaft for rotation therewith.

A fresh food rack gear is slidably mounted to the plate and includes a toothed section engaging the fresh food pinion gear for rotation of the fresh food control shaft in response to sliding movement of the fresh food rack gear. The fresh food rack gear includes an operating handle projecting forward of the plate. A freezer rack gear is slidably mounted to the plate and includes a toothed section engaging the freezer pinion gear for rotation of the freezer control shaft in response to sliding movement of the freezer rack gear. The freezer rack gear includes an operating handle projecting forward of the plate.

A lamp is mounted under the plate between the thermostats to light the fresh food compartment when its door is open. A cover includes a separate bezel and light shield, each removably mounted to the base. The bezel extends along the front of the plate, aligned with the thermostats. The bezel includes a pair of elongated slots receiving the thermostat operating handles and permitting predetermined sliding movement of the handles. The slots and handles are sized and shaped to permit removal of the bezel without removing the handles. The light shield includes a bottom wall extending under the plate, aligned with the thermostats and lamp. The light shield includes a light permeable area aligned with the lamp. The light shield also includes a frame encompassing the periphery of the bezel and having a to overlapping the upper edge of the bezel periphery.

DETAILED DESCRIPTION OF PREFERRED EMBODIMENT

Figure 1:
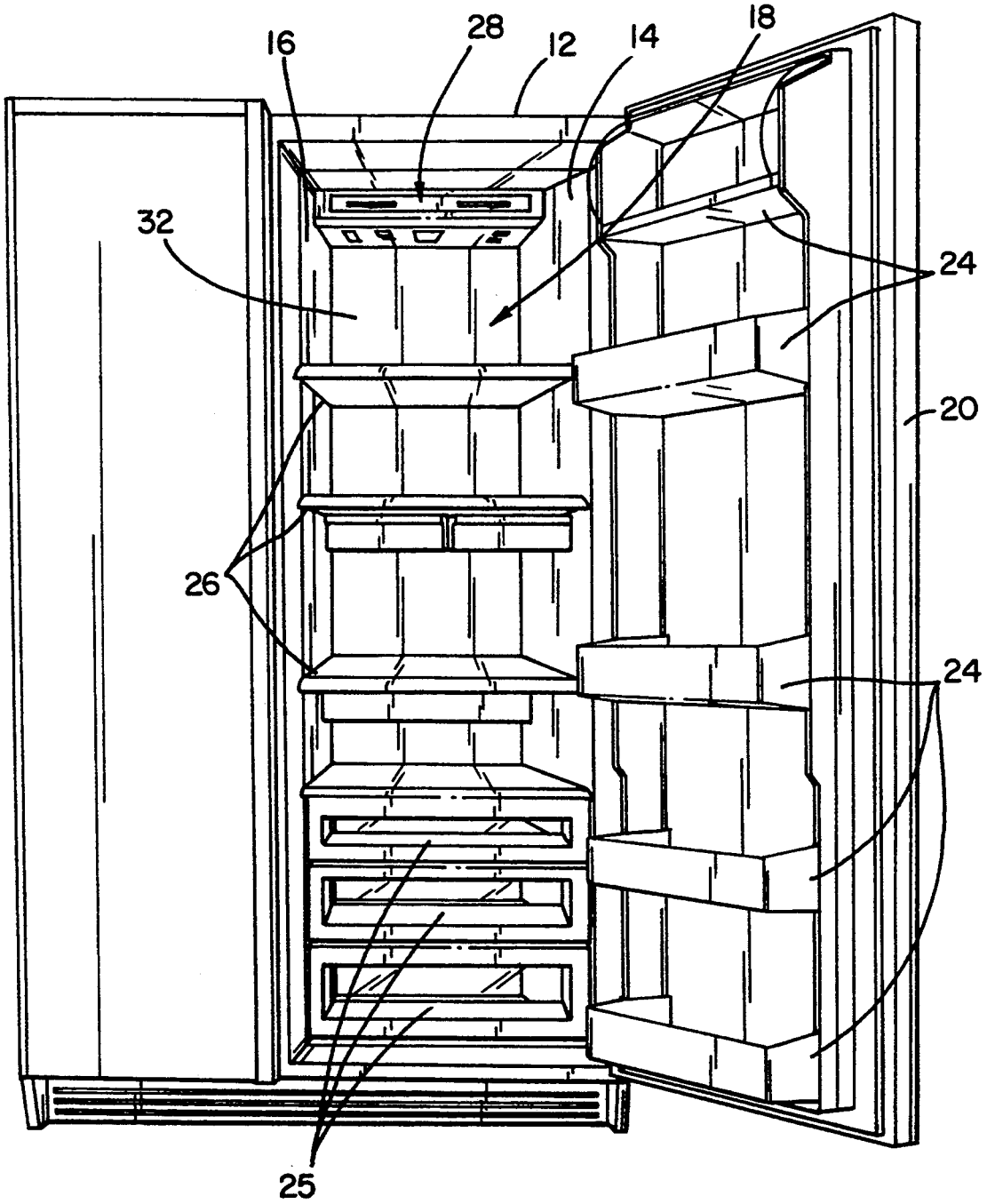
FIG. 1 is a simplified front perspective view of a side-by-side refrigerator, with the door for the fresh food compartment open for purposes of illustration.
Figure 3:
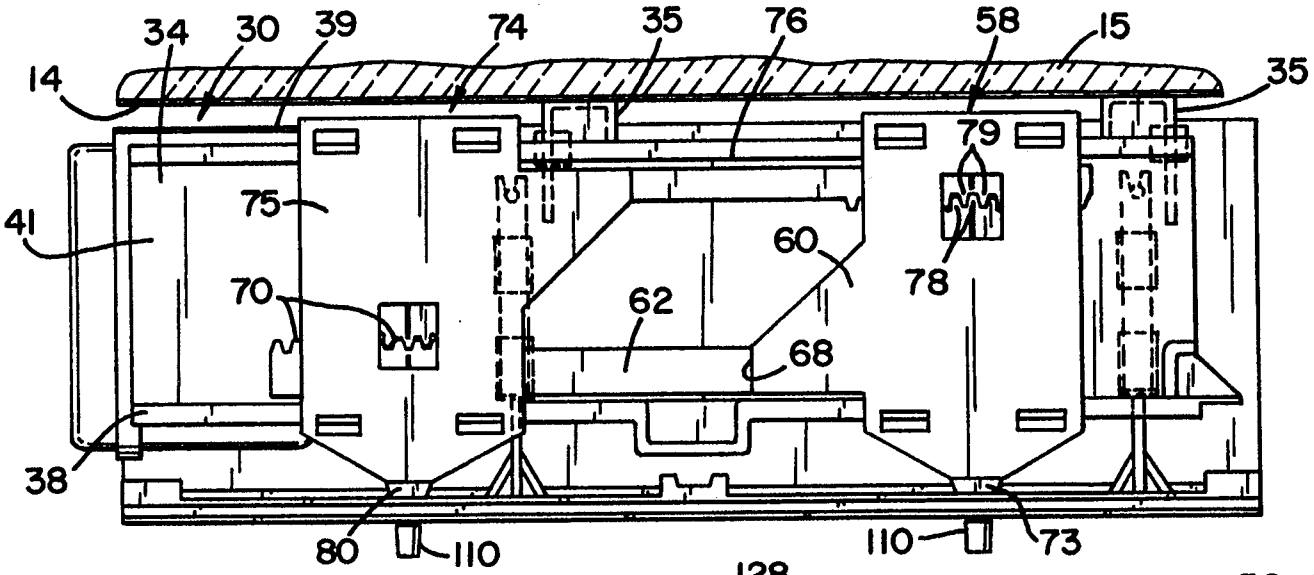
FIG. 3 is a plan view of the control mechanism of FIG. 2, with the view being somewhat simplified and with some parts omitted for the sake of simplicity.
Figure 4:
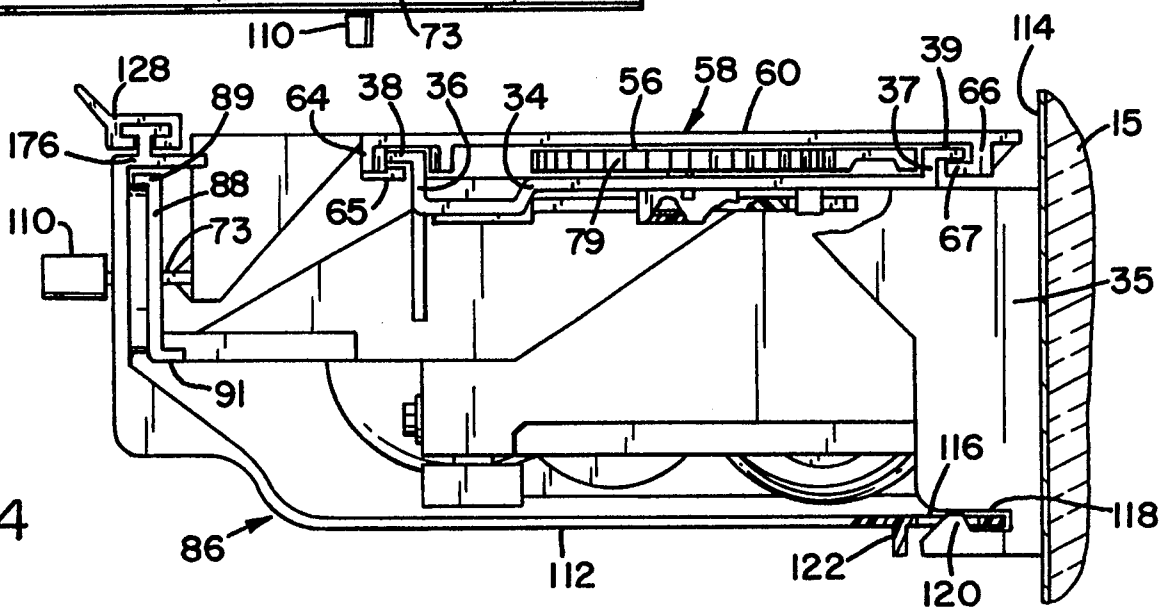
FIG. 4 is an end elevation view of the control mechanism of FIG. 2, with the view being somewhat simplified and with some parts omitted for the sake of simplicity.

Referring now to FIG. 1, there is illustrated a side-by-side refrigerator/freezer type of refrigerator 10 having an outer cabinet 12 and an inner liner 14 separated by suitable insulation 15 (see FIGS. 3 and 4). The liner 14 and a mullion or inner wall 16 divide the interior of the refrigerator into a fresh food compartment 18 and a freezer, not shown, arranged in a side-by-side configuration. Access to the fresh food compartment is provided by a fresh food door 20 and access to the freezer compartment is provided by a freezer door 22. Conveniently the doors 20, 22 are provided with shelves, such as those shown at 24. Also, fresh food compartment 18 is provided with storage drawers 25 and shelves 26. It will be understood that the freezer compartment also is normally provided with shelves and, in some models, with drawers.

Figures 2, 5, 6:
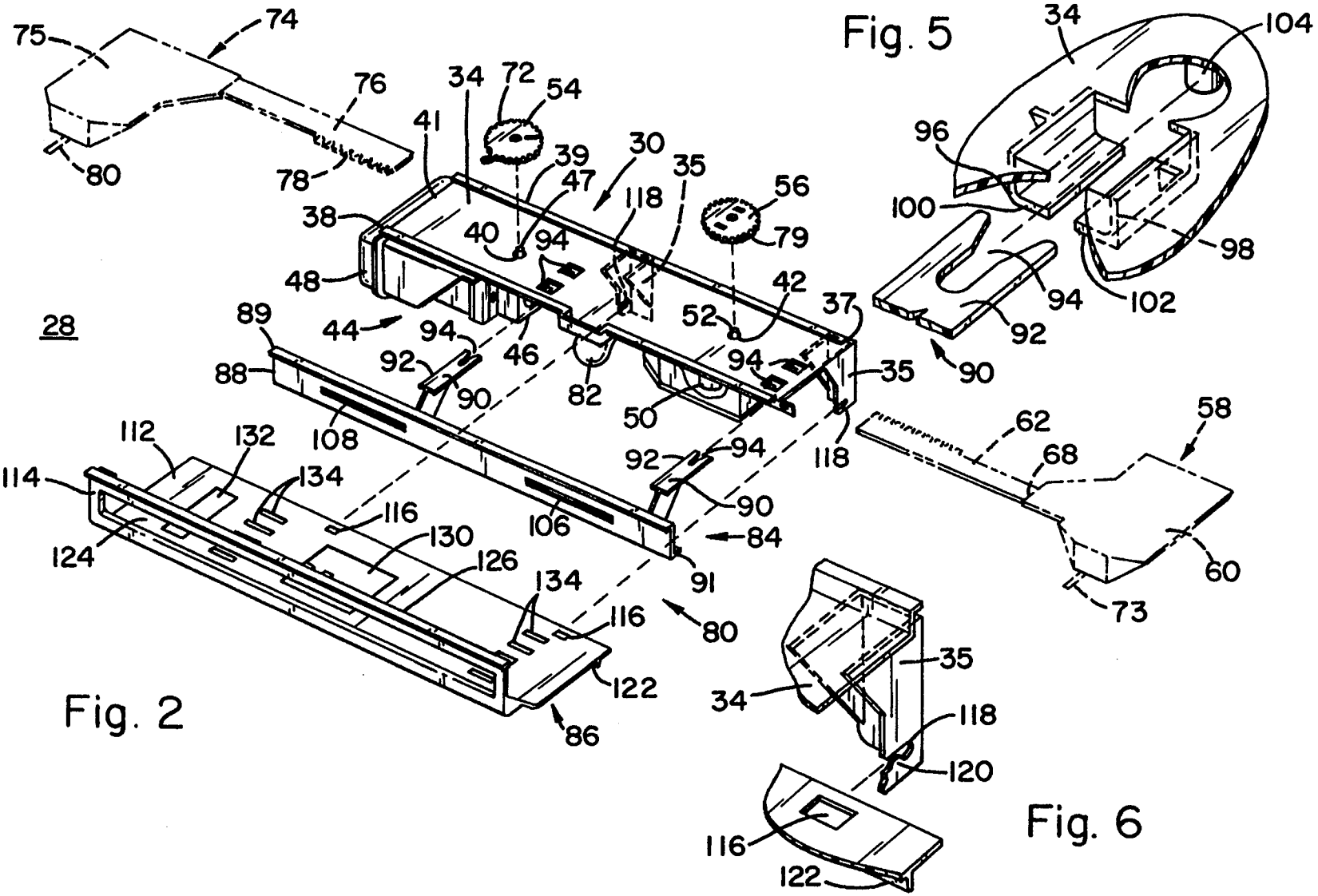
FIG. 2 is an exploded view of the control mechanism for the refrigerator of FIG. 1, with the view being somewhat simplified and with some parts omitted for the sake of simplicity.
FIG. 5 is a fragmentary, exploded perspective view illustrating a portion of the arrangement for removably mounting the bezel to the base.
FIG. 6 is a fragmentary exploded perspective view illustrating certain details of the arrangement for removably mounting the light shield to the base.

A control assembly or mechanism, generally indicated at 28, is provided near the top rear of the fresh food compartment 18. Referring now more particularly to FIGS. 2–4, the mechanism 28 includes a main support or base 30 that is mounted to the back wall 32 of the portion of liner 14 defining the fresh food compartment 18. The mechanism or assembly 28 includes a number of operative components, such as thermostats for controlling the temperature in each of the freezer and fresh food compartments and a lamp to light the interior of the fresh food compartment when door 20 is open.

The base or frame 30 includes an elongated support plate 34 with a number of integral mounting feet 35 spaced apart along its rear edge. Conveniently the base is integrally molded from a suitable plastic material such as polycarbonate sold by General Electric Company under the name LEXAN. The feet 35 are used to mount the base 30 to the liner wall 32 in the upper rear portion of fresh food compartment 18 and with the plate 34 in a horizontal orientation and extending transverse to the mullion 16. The front and rear edges of the plate 34 have longitudinal ribs 36, 37 which project vertically upward. Flanges 38, 39 project outwardly from the upper edges of the ribs 36, 37 respectfully. Thus the flanges 38, 39 are spaced above the top surface of and extend longitudinally along the front and rear edges of plate 34. A first opening 40 is provided in the plate 34 relatively close to the mullion end 41 of the plate 34. A second opening 42 is provided in the plate at a position more remote from the mullion 16.

An air flow mechanism 44, including a fresh food thermostat 46 is mounted to the under side of plate 34. The thermostat 46 is mounted so that its vertically disposed, rotary control shaft 47 is aligned with opening 40. Rotation of shaft 47 adjusts the temperature setting of thermostat 46 and thus the controlled temperature in the fresh food compartment. Air flow mechanism 44 also includes a conduit 48 which provides for selective flow of cold air from the freezer to the fresh food compartment 18 and discharges such air downwardly into the fresh food compartment. The thermostat operates a baffle (not shown) in the conduit 48 to control the amount of air flowing and thus the temperature of the fresh food compartment. Additional details of the assembly and operation of the air flow control mechanism may be had by reference to co-pending application 08/207,379-Martin et al, which is assigned to General Electric Company, assignee of the present invention, and which is hereby incorporated by reference.

A freezer thermostat 50 is mounted to the under side of plate 34 with its rotary control shaft 52 extending in vertical alignment with opening 42. Rotation of control shaft 52 adjusts the setting of thermostat 50. The capillary tube (not shown) of thermostat 50 extends across base 30 under plate 34 and into the freezer compartment. Thermostat 50 is connected to the refrigeration system and causes it to operate so as to maintain the temperature of the freezer compartment within the temperature range set by rotation of shaft 52. Conveniently a protective housing 53 surrounds thermostat 50.

A fresh food pinion gear 54 is positioned above the plate 34 and is connected to the shaft 47 of fresh food thermostat 46 for rotation therewith. The exact configuration of the shaft 47 and the mating portion of pinion gear 54 is not critical, so long as the gear and shaft are operatively connected and the pinion gear is positioned above the plate 34.

A freezer pinion gear 56 is positioned above the plate 34 and is connected to the shaft 52 of freezer thermostat 50 for rotation therewith. The exact configuration of the shaft 52 and the mating portion of pinion gear 56 is not critical, so long as the gear and shaft are operatively connected and the pinion gear is positioned above the plate 34.

Referring now to FIGS. 2–4, the fresh food pinion gear is rotated by a fresh food rack gear 58, which includes a base portion 60 and an elongated, projecting arm 62 integrally molded from a suitable plastic material, such as LEXAN polycarbonate. The front and rear edges of the base portion 60 are formed with downwardly projecting ribs 64, 66 that terminate in inwardly projecting flanges 65, 67, respectively. The base portion 60 is mounted on top of plate 34 with the flanges 38, 39 of plate 34 in interfitting relationship with the flanges 65, 67 of the base 60. The base portion 60 is supported by the flanges 38, 39 in a position to pass over freezer pinion gear 56 as rack gear 58 slides along the plate 34. Arm 62 is offset downward of the base portion 60 at 68 so that it slides along plate 34 and is guided by rib 36. A number of teeth 70 are formed on the inner edge of arm 62 adjacent its distal end. The teeth 70 interfit with teeth 72 formed on the periphery of pinion gear 54. Thus sliding movement of rack gear 58 along plate 34 results in rotation of pinion gear 54 and control shaft 47 to adjust the temperature setting of fresh food thermostat 46. A handle 73 projects forwardly form the base portion 60, and thus from the plate 34, to provide a means for an user to slide the rack gear 58.

The freezer pinion gear 56 is selectively rotated by a freezer rack gear 74, that is substantially similar to rack gear 58. It has a base portion 75 and an elongated outwardly projecting arm 76. The front and rear edges of base portion 75 are formed with downwardly projecting ribs that terminate in inwardly projecting flanges, in the same manner as base portion 60 of fresh food rack gear 58. The base portion 75 is mounted on the plate 34 with its flanges interfitting with plate flanges 38, 39. The base portion is supported in a position to pass over fresh food pinion gear 54 as the rack gear 74 slides along the plate 34. Arm 76 is offset downward from the base 75 at 77 so that it slides along plate 34 and is guided by rib 37. A number of teeth 78 are formed on the inner edge of the distal end portion of arm 76. The teeth 78 interfit with teeth 79 on the periphery of freezer pinion gear 56. Thus sliding movement of rack gear 74 along plate 34 results in rotation of pinion gear 56 and control shaft 52 to adjust the temperature setting of freezer thermostat 50. A handle 80 projects forwardly from the base portion 75, and thus from the plate 34, to provide a means for an user to slide the rack gear 74.

Additional details of the construction, assembly and operation of the thermostat mechanisms, including the pinion and rack gears, and the mode of their operation may be had by reference to co-pending application 08/207,375-Martin et al, assigned to General Electric Company, assignee of the present invention, which is hereby incorporated herein by reference.

A lamp 82 is mounted to the under side of the plate 34 in a position between the thermostats 46, 50. A switch (not shown) is positioned to be operated by fresh food door 20 and is connected to lamp 82 so the lamp is energized whenever door 20 is open.

The control assembly 28 includes a removable cover assembly including a separate bezel 84 and light shield 86. The cover assembly normally is in place over the front and bottom of the various operative components to protect them and is selectively removed to provided access to the operative components, for example, so that an user can change a spent lamp 82.

The bezel 82 includes an elongated wall 88 with mounting fingers 90 projecting perpendicularly inward of the wall, relative to the fresh food compartment 18. For strength and stiffness, the upper and lower edges of the wall 88 are formed with oppositely projecting flanges 89, 91. The bezel preferably is integrally molded form a suitable plastic material, such as LEXAN polycarbonate. The distal end 92 of each finger 90 is bifurcated or split at 94. Referring now particularly to FIG. 5, the under side of plate 34 is provided with a series of spaced apart, downwardly projecting ribs 96, 98 which terminate in inwardly projecting flanges 100, 102. A post 104 projects downwardly of the plate 34 in alignment with each set of ribs 96, 98. More particularly there is a set of ribs and a post for each finger 90. In mounting the bezel, the fingers 90 are inserted between opposed sets of ribs 96, 98 and rest on the flanges 100, 102. The posts 104 are received in the splits 94 in the distal ends 92 of the corresponding fingers 90. In this manner the bezel is removably mounted to the base 30 with the bezel wall 88 extending along the front edge of plate 34 and vertically aligned with the operative components, such thermostats 46, 50 and lamp 82.

The wall 88 includes a pair of horizontally extending slots 106, 108 positioned to receive the thermostat operating handles 73, 80 respectively. The slots permit the handles to be moved along the plate to slide the rack gears and adjust the settings of the thermostats 46, 50. Preferably the position and length of each slot corresponds to the range of movement of the associated handle needed to adjust corresponding thermostat between its extreme settings. Conveniently the bezel can be provided with visual indicia to assist the user. For example markings can be provided adjacent the slots indicating the relationship between various positions of the handles and the temperature of the corresponding food storage compartment.

The size and shape of the handles 73, 80 and the slots 106, 108 are chosen so that the handles will pass through the slots. In this way the bezel can be mounted on and removed from the base 30 without the necessity of removing the rack gears. Thus, it is not necessary to dismantle in significant portion of the control mechanism in order to remove the cover. If desired, decorative knobs 110 may be placed on the distal ends of the handles 73, 80. In that event either the slots will be made wide enough to pass over the knobs or the knobs will be selectively removable from the handles.

The light shield 86 includes a generally horizontal bottom wall 112 and generally vertical front wall 114. The bottom wall has small openings 116 adjacent its rear edge and aligned with each mounting foot 35 of the base 30. Each foot 35 is formed with a small slit 118 aligned with a corresponding opening 116 and a tab 120 projects into each slit 118. The light shield 86 is removably mounted on the base 34 by inserting the rear portion of the bottom wall 112 into the slits 118 until the tabs 120 are received in the openings 116. If desired, the bottom wall 112 can include a downwardly projecting flange 122 to limit movement of the wall 112 into the slits 118.

The light shield front wall 114 has a generally rectangular opening 124 aligned with and just slightly smaller than bezel wall 88 so that the wall 114 forms a frame surrounding the periphery of wall 88. The top or upper edge of wall 114 is formed as an inwardly projecting flange 126 that overlaps the flange 89 at the top of wall 88. Thus the bezel provides vertical support to the wall 114. If desired, a gasket 128 can be attached to the top of flange 126 so as to engage the top wall of liner 14 and prevent air flow around the top of control mechanism 28.

Referring again to light shield bottom wall 112, a light permeable area 130 is provided in alignment with the lamp 82. Preferably the area 130 may include a diffuser to spread the light from lamp 82 and minimize shadows or glare. However, the exact form of area is not critical and, if desired, could even be a simple opening in the wall 112. An opening 132 is provided in wall 112 aligned with the air outlet of conduit 48 so that air flowing from the freezer can pass through the light shield to the fresh food compartment. Two spaced apart rows of small openings 134 are formed in the wall 112. They permit additional light to pass through the light shield and help assure that the temperature with in the control mechanism approximates the temperature in the fresh food compartment.

While a specific embodiment of the present invention has been illustrated and described herein, it is realized that modifications and changes will occur to those skilled in the art to which the invention pertains. It is intended to cover all such modifications and changes as fall within the true spirit and scope of the invention.

What is claimed is:

1. A refrigerator with a liner defining a food storage compartment, and a refrigerator control assembly including:

a base mounted within said compartment, said base including an elongated support plate extending generally horizontally from side-to-side within said compartment;

at least one thermostat mechanism mounted under and toward one end of said plate, said at least one thermostat mechanism having at least one operating handle projecting forward of said plate;

a lamp for lighting said compartment mounted under said plate to the side of said at least one thermostat mechanism;

a cover, said cover and said base including cooperating means for removably mounting said cover to said base;

said cover including a vertically disposed bezel extending along the front of said plate in line with said at least one thermostat mechanism and said lamp, said bezel including at least one elongated slot fitting around said at least one operating handle to permit side-to-side movement of said at least one handle for adjusting said at least one thermostat mechanism and permitting said bezel to be removed from said base without removing said at least one handle;

said cover also including a bottom wall extending along said plate below said at least one thermostat mechanism and said lamp and including a light permeable area aligned with said lamp.

2. A refrigerator as set forth in claim 1, including:

two thermostat mechanisms, mounted toward opposite ends of said plate, each of said mechanisms including an operating handle projecting forward of said plate;

and wherein said bezel includes two elongated slots, each slot receiving a corresponding one of said handles and having a predetermined length corresponding to a predetermined degree of adjustment of the corresponding thermostat mechanism.

3. A refrigerator as set forth in claim 1, wherein:

said cover includes said bezel and a separate light shield;

said bezel and said base include cooperating means for separately removably mounting said bezel to said base;

said light shield and said base include means for separately removably mounting said light shield to said base; and said light shield includes said bottom wall and an upstanding frame encompassing the periphery of said bezel, said frame having a top overlapping the upper edge of said bezel periphery.

4. A refrigerator as set forth in claim 3, wherein: said bezel includes a plurality of fingers received in slots formed in said base and each of said fingers includes a split distal end engaging a post on said base to removably mount said bezel to said base.

5. A refrigerator as set forth in claim 3, wherein: said base includes a plurality of mounting feet for mounting said base to said liner; each of said feet includes a slit to receive a predetermined portion of said light shield bottom wall and a tab extends into said slit, and each of said predetermined portions of said light shield bottom wall includes an opening to receive the corresponding tab.

6. A refrigerator having a liner defining a fresh food compartment and a freezer compartment in a side-by-side relationship and separated by a mullion, and a refrigerator control assembly including:

a base mounted in said fresh food compartment, said base including an elongated support plate extending horizontally within said fresh food compartment transverse to said mullion, said plate including a first opening therein closer to said mullion and a second opening therein more remote from said mullion;

a fresh food thermostat mounted under said plate and including a rotary control shaft aligned with said first opening;

a fresh food pinion gear positioned above said plate and operatively connected to said fresh food thermostat control shaft for rotation therewith;

a freezer thermostat mounted under said plate and including a rotary control shaft aligned with said second opening;

a freezer pinion gear positioned above said plate and operatively connected to said freezer thermostat control shaft for rotation therewith;

a fresh food rack gear slidably mounted to said base and including a toothed section engaging said fresh food pinion gear for rotation of said fresh food control shaft in response to sliding movement of said fresh food rack gear, said fresh food rack gear including an operating handle projecting forward of said plate;

a freezer rack gear slidably mounted to said base and including a toothed section engaging said freezer pinion gear for rotation of said freezer control shaft in response to sliding movement of said freezer rack gear, said freezer rack gear including an operating handle projecting forward of said plate;

a lamp mounted under said plate between said fresh food and freezer thermostats for lighting said fresh food compartment;

a cover, said cover and said base including cooperating means for removably mounting said cover to said base;

said cover including a vertically disposed bezel extending along the front of said plate in line with said thermostats and said lamp, said bezel including a pair of elongated slots, each slot receiving one of said fresh food and said freezer operating handles to permit side-to-side movement of the corresponding handle for adjusting the corresponding thermostat and each slot and handle being complimentarily shaped and sized to permit removal of said bezel without removal of said rack gears;

said cover also including a bottom wall extending along said plate below said thermostats and lamp and including a light permeable area aligned with said lamp.

7. A refrigerator as set forth in claim 6, wherein: each bezel slot has a predetermined length corresponding to a predetermined degree of adjustment of the corresponding thermostat.

8. A refrigerator as set forth in claim 6, further including:

conduit means associated with said fresh food thermostat for conducting cold air from said freezer to said fresh food compartment, said conduit having an outlet adjacent said fresh food thermostat; and wherein said bottom wall includes an air passage opening aligned with said conduit outlet.

9. A refrigerator as set forth in claim 6, wherein:

said cover includes said bezel and a separate light shield;

said bezel and said base include cooperating means for separately removably mounting said bezel to said base;

said light shield and said base include cooperating means for separately removably mounting said light shield to said base; and said light shield includes said bottom wall and an upstanding frame encompassing the periphery of said bezel, and said frame has a top overlapping the upper edge of said bezel periphery.

10. A refrigerator as set forth in claim 9, wherein: said bezel includes a plurality of fingers received in slots formed in said base and each of said fingers includes a split distal end engaging a post on said base to removable mount said bezel to said base.

11. A refrigerator as set forth in claim 9, wherein: said base includes a plurality of mounting feet for mounting said base to said liner; each of said feet includes a slit to receive a predetermined portion of said light shield bottom wall and a tab extends into each slit; and each of said predetermined portions of said bottom wall includes an opening to receive the corresponding tab.

* * * * *